United States Patent [19]

Macholdt et al.

[11] Patent Number: 5,061,585

[45] Date of Patent: Oct. 29, 1991

[54] BLUE COLORING AGENT FOR ELECTRO-PHOTOGRAPHIC COPYING PROCESSES WITH POSITIVE CONTROL ACTION

[75] Inventors: Hans-Tobias Macholdt, Darmstadt; Alexander Sieber, Frankfurt am Main, both of Fed. Rep. of Germany

[73] Assignee: Hoechst Aktiengesellschaft, Frankfurt am Main, Fed. Rep. of Germany

[21] Appl. No.: 664,471

[22] PCT Filed: Jan. 7, 1987

[86] PCT No.: PCT/EP87/00003

§ 371 Date: Jun. 1, 1989

§ 102(e) Date: Jun. 1, 1989

[87] PCT Pub. No.: WO88/04442

PCT Pub. Date: Jun. 16, 1988

Related U.S. Application Data

[63] Continuation of Ser. No. 372,332, Jun. 1, 1989, abandoned.

[30] Foreign Application Priority Data

Dec. 5, 1986 [DE] Fed. Rep. of Germany ..... 3641525

[51] Int. Cl.[5] ..... G03G 9/09; G03G 9/097; G03G 13/08

[52] U.S. Cl. ..... 430/106; 430/110; 430/120

[58] Field of Search ..... 430/106, 110, 120

[56] References Cited

U.S. PATENT DOCUMENTS

| | | | |
|---|---|---|---|
| 4,560,635 | 12/1985 | Hoffend et al. | 430/106.6 |
| 4,822,707 | 4/1989 | Inoue et al. | 430/106 |

FOREIGN PATENT DOCUMENTS

| | | | |
|---|---|---|---|
| 0141377 | 5/1985 | European Pat. Off. . | |
| 1919724 | 11/1970 | Fed. Rep. of Germany . | |
| 51-11455 | 1/1976 | Japan | 430/106 |
| 52-113739 | 9/1977 | Japan . | |
| 54-84732 | 7/1979 | Japan . | |
| 55-79456 | 6/1980 | Japan | 430/110 |
| 56-46248 | 4/1981 | Japan . | |
| 58-97056 | 6/1983 | Japan . | |
| 59-77447 | 5/1984 | Japan . | |
| 60-107654 | 6/1985 | Japan . | |
| 61-6661 | 1/1986 | Japan . | |

*Primary Examiner*—Roland Martin

[57] ABSTRACT

Blue coloring agent with positive control effect for electrophotographic copying processes, composed essentially of the compound of the formula

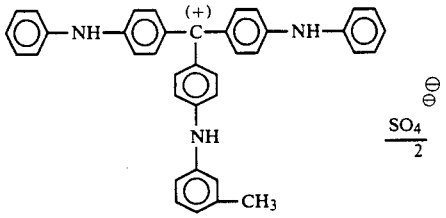

the X-ray diffraction diagram of which contains a strong band at 2° (CuK $\alpha$)=18.47, three medium-strong bands at 2° (CuK $\alpha$)=5.97, 12.01 and 13.90 and weak broad bands at 2° (CuK $\alpha$)=20.0, 21.7, 22.5, 24.8, 28.2, 30.7 and 32.2, and the use of the coloring agent for the production of toners and developers which are used for the electrophotographic copying or duplication of originals, and also for the printing of electronically, optically or magnetically stored information or in color proofing.

8 Claims, No Drawings

BLUE COLORING AGENT FOR ELECTRO-PHOTOGRAPHIC COPYING PROCESSES WITH POSITIVE CONTROL ACTION

This application is a continuation of U.S. application Ser. No. 372,332, now abandoned.

DESCRIPTION

The present invention relates to a blue coloring agent based on a triaminotriphenylmethane dyestuff for dyeing toners and developers for electrophotographic copying processes which is present in controlled substitution as a highly crystalline sulfate salt and consequently has particularly beneficial charge control properties. Owing to its color, the coloring agent is furthermore suitable as a color-imparting component for blue and green toners and developers or as a color modifier for black and brown toners and developers.

In electrophotographic copying processes, a "latent charge image" is produced, for instance, on a photoconductor. This is carried out, for instance, by charging up the photoconductor with a corona discharge and subsequently exposing the electrostatically charged surface of the photoconductor to an image, the drainage of charge to the earthed substrate at the exposed points being effected by the exposure. Subsequently, the "latent charge image" produced in this manner is developed by applying a toner.

In a subsequent step, the toner is transferred from the photoconductor to, for instance, paper, textiles, foils or plastic and fixed thereon, for instance, by pressure, irradiation, heat or exposure to solvents. The used photoconductor is subsequently cleaned and is available for a fresh copying operation.

Numerous patents describe the optimization of toners, inter alia, the effect of the toner binder (variation of resin/resin components or wax/wax components), the effect of control agents or other additives or the effect of additives or the effect of carriers (in two-component developers) and magnetic pigments (in one-component developers) being investigated (U.S. Pat. No. 2,221,776). A measure of the toner quality is its specific charging capacity Q/M (charge per unit mass).

Recently, positively chargeable toners have acquired significance, inter alia owing to their use in laser printers employing inorganic photoconductors or in copiers which are equipped with organic photoconductors (OPC) for copying the latent charge image. The inexpensive organic photoconductors are being used to an increasing extent, for instance, as a drum or master strip, primarily because of their versatile use, and because they can be simply disposed of. In order to obtain electrophotographic toners or developers with positive triboelectric charging capacity, so-called control agents (also termed charge control agents) are often added. In addition to the sign of the charge control, the extent of the control effect is important since a higher efficiency makes it possible to use a smaller amount.

Apart from sign and the level of the control effect of a charge control agent, its effect on the charging constancy of the toner is important. In practice this is of central significance insofar as the toner in the developer mixture is exposed to a considerable activation time before it is transferred to the photoconductor because it may remain in the developer mixture for a period covering the production of up to several thousand copies during the copying and printing operation. The requirement imposed on the toner is therefore that, regardless of the activation time, as constant a toner charging capacity as possible is ensured. Since toner binders alone, effect, as a rule, a considerable change in the charging capacity as a function of the activation time, it is the task of a charge control agent, on the one hand, to set the sign and level of the toner charging capacity, and, on the other hand, to counteract the drift in charging capacity of the toner binder and to ensure constancy of the toner charging capacity. Charge control agents which are unable to prevent the toner or developer exhibiting a high charge drift (aging) for a prolonged duration of use which may even have the effect that the toner or developer undergoes a charge reversal are therefore unsuitable for practical use.

The object of the present invention was therefore to find a charge control agent with positive control effect which can be set as a function of concentration and the charge control properties of which help the toner or developer to achieve as low aging symptoms as possible and which, in addition, is suitable as a coloring agent for blue and green toners and developers or as a modifying additive for black, yellow, red and brown toners and developers.

To obtain positively chargeable toners and developers, use is frequently made of, for instance, nigrosines, quaternary ammonium compounds (U.S. Pat. No. 4,560,635) or metal complexes (European Patent 0,141,377) as charge control agents. Triphenylmethane dyestuffs are described in numerous patents as positive charge control agents, but the compounds claimed hitherto have found hardly any application because they were always beset with certain deficiencies.

Thus, for instance, the Japanese Patent Applications 58-97056 and 56-46248 describe the use of specific rosanilinesulfonic acid derivatives as positive charge control agents. German Offenlegungsschrift 3,527,306 describes the chlorides of certain triphenylmethane dyestuffs as positive charge control agents. The Japanese Patent Application 60-107654 describes the effect of halogenated triphenylmethane dyestuffs, and the examples in the Japanese Patent Application 59-77447, 54-84732, 61-6661 and 52-113739 describe the effect of some salts (triphenyl borates, chlorides, hydrogen sulfates) of specific triphenylmethane dyestuff derivatives. Surprisingly, it has now emerged that a specially substituted triaminotriphenylmethane coloring agent in the form of its highly crystalline "color base sulfate" (color base sulfate is used to describe the product of the reaction of a phenylimino-2,5-cyclohexadien-1-ylidenemethylene)bisdiphenylamine, the "color base", with sulfuric acid) has a very high positive concentration-dependent control effect and that said highly crystalline color base sulfate imparts surprisingly beneficial properties in relation to their aging to toners and developers in triboelectric charging and, consequently, is particularly suitable for practical use.

In addition, said coloring agent is suitable as a color-imparting component for blue and green toners and developers or as a modifying component for black, yellow, red and brown toners and developers.

The subject of the present invention is therefore the use of the blue coloring agent, composed essentially of the compound of the formula:

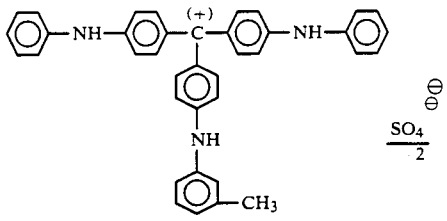

the X-ray diffraction diagram of which contains a strong band at 2δ° (CuKα)=18.47, three medium-strong bands at 2δ° (CuKα)=6.97, 12.01, and 13.90 and weak broadbands at 2δ° (CuKα)=20.0, 21.7, 22.5, 24.8, 28.2, 30.7 and 32.2, as a positive charge control agent for electrophotographic toners and developers, which can be used for the electrophotographic copying or duplication of originals and also for the printing of electronically, optically or magnetically stored information or in color proofing, and also its use as a color-imparting component for blue and green toners and developers or as a color modifier for black, red, yellow and brown toners and developers.

Thus, for instance, a toner containing 5% by weight of the coloring agent according to the invention has a charging capacity of +49.1 μC/g, and a toner containing 1 or 0.5% by weight of the coloring agent according to the invention has a charging capacity of +21.5 μC/g or +15.8 μC/g respectively (see Examples 1 to 3 below).

If the monosulfonic acid (Reflex Blue R, C.I. Pigment Blue 61) of the claimed compound is used instead of the color base sulfate according to the invention, then it has a much lower charge control property in the corresponding toner. A toner containing 5% by weight of this charge control agent (monosulfonic acid) exhibits, for example, a charging capacity of only +18.6 μC/g (Comparison Example 6), and a toner containing 1 or 0.5% by weight of said agent has a charging capacity of only +4.8 μC/g or −5.4 μC/g respectively (Comparison Examples 7 and 8). In contrast to the control agent according to the invention, adding 0.5% by weight of said control agent (monosulfonic acid) is therefore no longer adequate to enable the triboelectric negative natural charging capacity of the resin (toner binder) to be counteracted. Poorer properties are also exhibited in relation to the constancy of its charge control effect (aging), including reversal of the polarity of the charging capacity (Comparison Example 6). After a certain activation time, said control agent is no longer capable of adequately counter-controlling the triboelectric negative natural charging capacity of the resin.

Compared with, for instance, the chlorides of the corresponding color base, the highly crystalline color base sulfate according to the invention has markedly more beneficial charge control properties (Comparison Example 5), just as toners and developers containing the highly crystalline modification of the color base sulfate according to the invention exhibit a markedly better continuous loading capacity (fewer aging symptoms) than those containing an X-amorphous modification of the color base sulfate (Comparison Example 4).

Compared with Comparison Example 12, it emerges that the very good suitability of the coloring agent according to the invention as a positive charge control agent is due, inter alia, to systematically dispensing with sulfonic acid groups. The coloring agent used in Comparison Example 12 is the trisulfonic acid derivative of the claimed coloring agent instead of the sulfate salt. The corresponding toner exhibits a charging capacity of −6.5 μC/g; no positive control effect can be detected.

The triphenylmethane color base (C.I. Solvent Blue 125) used in the Comparison Examples 9, 10 and 11 is not suitable for practical use, on the one hand, because of its only moderate charge control power, and on the other hand, because of the poor constancy of its charge control effect (aging) which results in a reversal of the polarity of the toner (Comparison Example 9).

The preparation of the coloring agent according to the invention is described in German Patent 1,919,724.

Compared with the triphenylmethane coloring agents cited in the comparison examples, the coloring agent according to the invention differs in its markedly stronger positive charge control behavior and in the markedly better constancy of its charge control effect.

The coloring and control agent according to the invention makes it possible to color or to modify a toner or developer simultaneously and to control it in a specifically triboelectrically positive manner depending on concentration, and this has, inter alia, the advantage that in addition to the coloring agent, a control agent substance does not have to be additionally incorporated in the toner formulations which are in any case already complicated. As a result, problems of compatibility, miscibility or control agent migration are eliminated.

To incorporate the coloring agent according to the invention in the toner binder, either dried and ground coloring agent or an aqueous dispersion or a press cake can in principle be used.

The level of the electrostatic charging of the toner when the claimed coloring agent is used was measured on standard systems under identical conditions (such as identical dispersion times, identical particle size distribution, identical particle shape) at 23° C. and 50% relative atmospheric humidity. The toner is activated in a two-component developer by vortexing the toner with a carrier (3 parts of toner to 97 parts of carrier) on a roller mixer (150 revolutions per minute).

The particle size has a great influence in determining the Q/M value. Strict care was taken to ensure that the toner samples obtained in the sieving operations and cited in the examples below were uniform in relation to the particle size distribution.

The examples below serve to explain the invention without limiting it thereto. The parts specified signify parts by weight.

EXAMPLE 1

5 parts of the coloring agent claimed according to the invention were dispersed in 95 parts of toner binder (®Dialec S 309 manufactured by Diamond Shamrock (styrene/methacrylate copolymer)) for 60 minutes using a kneader manufactured by Werner & Pfleiderer (Stuttgart). Subsequently, grinding was carried out using the general purpose laboratory mill 100LU (manufactured by Alpine, Augsburg), followed by grading using the centrifugal classifier 100MZR (manufactured by Alpine). The required particle fraction was activated with a carrier composed of magnetite particles coated with styrene/methacrylate copolymer 90:10 and having a size of 50 to 200 μm of the type 90 μm Xerographic Carrier manufactured by Plasma Materials Inc.

The measurement is carried out on a standard Q/M measuring bench (cf. in this connection J. H. Dessauer and H. E. Clark, "Xerography and related Processes (sic)", Focal Press, N.Y. 1965, page 289); a sieve with a mesh size of 25 μm (508 mesh per inch) manufactured by Gebrüder Kufferath, Düren was used to ensure that no carrier can be entrained in the toner blowouts.

For an activation time of 30 minutes, a Q/M value of +49.1 μC/g was found.

For an activation time of 2 hours, a Q/M value of +34.7 μC/g was found.

For an activation time of 24 hours, a Q/M value of +28.4 μC/g was found.

EXAMPLE 2

The procedure was as described in Example 1, with the difference that instead of 5 parts being used in 95 parts of toner binder, only 1 part of the coloring agent according to the invention was used in 99 parts of toner binder.

For an activation time of 30 minutes, a Q/M value of +21.5 μC/g was found.

EXAMPLE 3

The procedure was as described in Example 1, with the difference that instead of 5 parts being used in 95 parts of toner binder, only 0.5 part of the coloring agent according to the invention was used in 99.5 parts of toner binder.

For an activation time of 30 minutes, a Q/M value of +15.8 μC/g was found.

EXAMPLE 4 (COMPARISON EXAMPLE)

The procedure was as in Example 1, with the difference that instead of 5 parts of the coloring agent according to the invention being used, 5 parts of an X-amorphous form of the coloring agent according to the invention were used.

For an activation time of 30 minutes, a Q/M value of +51.8 μC/g was found.

For an activation time of 2 hours, a Q/M value of +39.1 μC/g was found.

For an activation time of 24 hours, a Q/M value of +22.3 μC/g was found.

EXAMPLE 5 (COMPARISON EXAMPLE)

The procedure was as in Example 1, with the difference that instead of 5 parts of the coloring agent according to the invention, 5 parts of "color base chloride" were incorporated in the toner. (The "color base chloride" is prepared by reacting the color base cited in German Patent 1,919,724, Example 9, with HCl).

For an activation time of 30 minutes, a Q/M value of +1.0 μC/g was found.

For an activation time of 2 hours, a Q/M value of −0.4 μC/g was found.

For an activation time of 24 hours, a Q/M value of +3.2 μC/g was found.

EXAMPLE 6 (COMPARISON EXAMPLE)

The procedure was as described in Example 1, with the difference that instead of 5 parts of the coloring agent according to the invention, 5 parts of the conventionally used triaminotriphenylmethane coloring agent (C.I. Pigment Blue 61) (Reflex Blue R)) were incorporated in the toner.

For an activation time of 30 minutes, a Q/M value of +18.6 μC/g was found.

For an activation time of 2 hours, a Q/M value of +1.8 μC/g was found.

For an activation time of 24 hours, a Q/M value of −5.2 μC/g was found.

EXAMPLE 7 (COMPARISON EXAMPLE)

The procedure was as described in Example 6, with the difference that instead of 5 parts being incorporated in 95 parts of toner binder, only 1 part of Reflex Blue R was incorporated in 99 parts of toner binder.

For an activation time of 30 minutes, a Q/M value of +4.8 μC/g was found.

EXAMPLE 8 (COMPARISON EXAMPLE)

The procedure was as described in Example 6, with the difference that instead of 5 parts being incorporated in 95 parts of toner binder, only 0.5 part of Reflex Blue R was incorporated in 99.5 parts of toner binder.

For an activation time of 30 minutes, a Q/M value of −5.4 μC/g was found.

EXAMPLE 9 (COMPARISON EXAMPLE)

The procedure was as in Example 1, with the difference that instead of 5 parts of the claimed coloring agent, 5 parts of the free base of a triaminotriphenylmethane coloring agent were incorporated in the toner. The coloring agent for the comparison is the C.I. Solvent Blue 66 (brilliant blue base SM).

For an activation time of 30 minutes, a Q/M value of +29.2 μC/g was found.

For an activation time of 2 hours, a Q/M value of +12.7 μC/g was found.

For an activation time of 24 hours, a Q/M value of −4.8 μC/g was found.

EXAMPLE 10 (COMPARISON EXAMPLE)

The procedure was as described in Example 9, with the difference that instead of 5 parts being incorporated in 95 parts of toner binder, only 1 part of brilliant blue base SM was incorporated in 99 parts of toner binder.

For an activation time of 30 minutes, a Q/M value of +7.2 μC/g was found.

EXAMPLE 11 (COMPARISON EXAMPLE)

The procedure was as described in Example 9, with the difference that instead of 5 parts being incorporated in 95 parts of toner binder, 0.5 part of brilliant blue base SM was incorporated in 99.5 parts of toner binder.

For an activation time of 30 minutes, a Q/M value of +4.0 μC/g was found.

EXAMPLE 12 (COMPARISON EXAMPLE)

The procedure was as described in Example 1, with the difference that instead of 5 parts of the coloring agent according to the invention, 5 parts of ink blue RG 1 were incorporated in the toner.

For an activation time of 30 minutes, a Q/M value of −6.5 μC/g was found.

We claim:

1. A toner composition for electrophotographic copying processes comprising a toner binder and a positive charge controlling agent consisting essentially of a crystalline sulfate salt of the formula

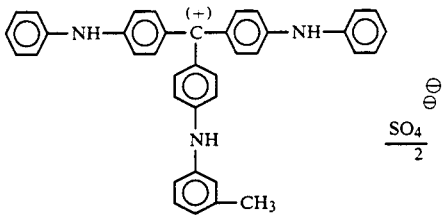

the X-ray diffraction of diagram of which contains a strong band at 2δ° (CuKα)=18.47, three medium-strong bands at 2δ° (CuKα)=5.97, 12.01, 13.90, and weak broad bands at 2δ° (CuKα)=20.0, 21.7, 22.5, 24.8, 28.2, 30.7 and 32.2.

2. A toner composition according to claim 1 wherein the composition contains 0.5 to 5% by weight of said crystalline salt.

3. A toner composition according to claim 1, wherein the balance of said toner composition consists essentially of the toner binder.

4. A toner composition for electrophotographic copying processes consisting essentially of a toner binder and a crystalline sulfate salt of the formula

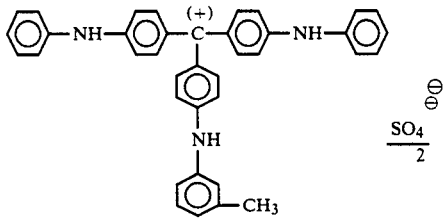

the X-ray diffraction diagram of which contains a strong band at 2δ° (CuKα)=18.47, three medium-strong bands at 2δ° (CuKα)=5.97, 12.01, 13.90, and weak broad bands at 2δ° (CuKα)=20.0, 21.7, 22.5, 24.8, 28.2, 30.7 and 32.2.

5. A toner composition according to claim 4 wherein the composition contains 0.5 to 5% by weight of said crystalline sulfate salt.

6. A toner composition according to claim 5, wherein the balance of said toner composition consists essentially of the toner binder.

7. A method of developing a latent magnetic or electrostatic image using a toner or developer having incorporated therein a blue coloring agent with positive control effect, said blue coloring agent consisting essentially of a crystalline sulfate salt of the formula

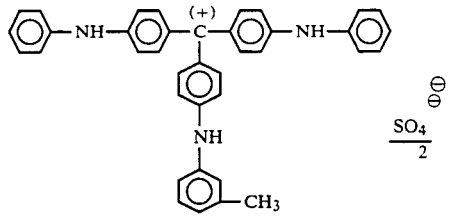

the X-ray diffraction diagram of which contains a strong band at 2δ° (CuKα)=18.47, three medium-strong bands at 2δ° (CuKα)=5.97, 12.01, 13.90, and weak broad bands at 2δ° (CuKα)=20.0, 21.7, 22.5, 24.8, 28.2, 30.7 and 32.2.

8. A method according to claim 7, wherein the toner or developer is colored blue or green by the incorporation of said blue coloring agent, or a black, red, yellow, or brown toner or developer is modified in color by the incorporation of said blue coloring agent.

* * * * *

UNITED STATES PATENT AND TRADEMARK OFFICE
CERTIFICATE OF CORRECTION

PATENT NO.: 5,061,585

DATED: October 29, 1991

INVENTOR(S): Hans-Tobias Macholdt, Alexander Sieber

It is certified that error appears in the above-identified patent and that said Letters Patent is hereby corrected as shown below:

Claim 1, col. 7, line 11 after the structural formula, after "diffraction" delete "of".

Signed and Sealed this

Twentieth Day of July, 1993

*Attest:*

*Attesting Officer*

Michael K. Kirk

MICHAEL K. KIRK

*Acting Commissioner of Patents and Trademarks*